United States Patent [19]

Barry

[11] 4,093,235

[45] June 6, 1978

[54] TOURIST GAME

[75] Inventor: Dennis P. Barry, Bronx, N.Y.

[73] Assignee: Publishers Planning Inc., New York, N.Y.

[21] Appl. No.: 709,633

[22] Filed: Jul. 29, 1976

[51] Int. Cl.[2] ..... A63F 3/04

[52] U.S. Cl. ..... 273/254; 273/256

[58] Field of Search ..... 273/134

[56] References Cited

U.S. PATENT DOCUMENTS

| | | | |
|---|---|---|---|
| 1,544,254 | 6/1925 | May et al. | 273/134 AC |
| 1,550,190 | 8/1925 | Warner | 273/134 AC |
| 1,635,734 | 7/1927 | Ziegler | 273/134 AC |
| 3,114,551 | 12/1963 | Ovitz | 273/134 AC |
| 3,572,718 | 3/1971 | Moore | 273/134 AD |
| 3,759,520 | 9/1973 | Straitwell | 273/134 AD |
| 3,807,739 | 4/1974 | Henley et al. | 273/134 AF |
| 4,010,957 | 3/1977 | Tricoli | 273/134 AD |

*Primary Examiner*—Richard C. Pinkham
*Assistant Examiner*—Harry G. Strappello
*Attorney, Agent, or Firm*—Darby & Darby

[57] ABSTRACT

A board game apparatus for educating players with respect to tourist attractions within a particular geographical region. The apparatus includes a board having a continuous path comprising areas representing particular localities within the geographical region and a series of cards having either questions concerning the various tourist attractions of the localities or other instructions. Another set of cards represent rewards obtained during the course of playing the game.

Each of the areas representing the localities are appropriately marked to indicate whether the particular locality is accessible by boat and/or by airplane while all of the localities are accessible by car. A set of tokens are provided for each player, each set including an automobile token, a boat token and an airplane token, each respective token being permitted to occupy only those areas appropriately designated as being accessible by that particular instrumentality.

25 Claims, 14 Drawing Figures

TOURIST GAME

BACKGROUND OF THE INVENTION

This invention relates generally to board game apparatus and, in particular, to a board game apparatus intended to educate players with respect to tourist attractions found in various geographical localities.

The board game apparatus of the present invention is intended not only to provide for the enjoyment of the players but also to educate the players with respect to the particular geographical localities with which the game deals. Although the embodiment presently disclosed deals with geographical localities in the State of Florida, the invention is intended to be applicable to many other localities, e.g., Ireland, the Caribbean, South America, Canada, other states of the United States, etc. It is an object of the present invention to acquaint and educate the players of the game with the geography of the particular region with which the game deals and, in addition, to educate the players with respect to various tourist attractions located in various localities within the particular geographical region which is the subject of the game.

Briefly, in accordance with the present invention, there is provided a game board having a series of marked areas constituting a path extending about the board, each of the marked areas representing a particular geographical locality of a region illustrated by a map outline in the central area of the board. Each of the areas is appropriately marked to indicate whether the particular locality represented by it is accessible by boat and/or by airplane. All of the localities are accessible by automobile. It is as to various tourist attractions found within the particular geographical localities represented by the marked areas with which the game is concerned.

Each player is provided with a set of tokens, each set preferably comprising an automobile, a boat and an airplane. In playing the game, each player moves each one of his set of tokens around the board in succession, i.e., a player first moves around the board by automobile, then by boat and, finally, by airplane. In doing so, the automobile token may occupy any of the designated areas while the boat and airplane tokens may occupy only those areas designated as being accessible by boat and airplane, respectively.

One feature of the game is that players may purchase certain of the designated localities and charge rental to opposing players who land there. After purchase, a player may improve his property by constructing buildings thereon to raise the rental fees to be exacted from opposing players.

Another feature of the game is to obtain rewards by successfully answering questions relating to tourist attractions within the particular localities on the game board.

With these basics of the game in mind, the game will be described in detail as follows in connection with the accompanying drawings in which.

Figure 6:
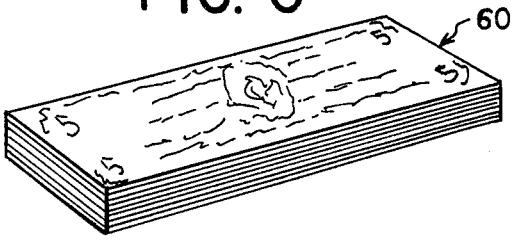
Figure 7:
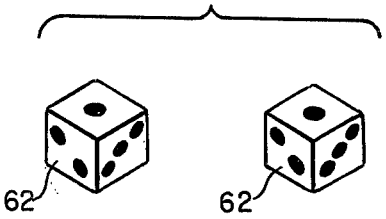
Figure 8:
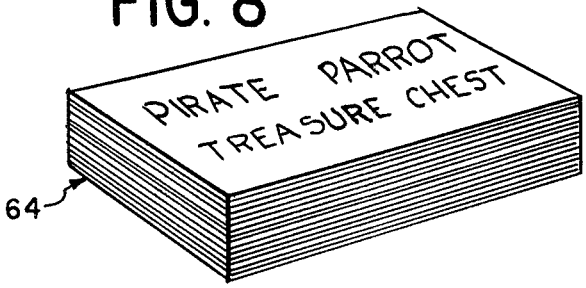

FIGS. 5*a* through *d* illustrate a motel, a condominium, a marina club and a riding club, respectively, each of which constitutes an improvement which may be made in the localities after being purchased by a player;

FIG. 6 illustrates scrip money (or travelers checks) used in playing the game;

FIG. 7 illustrates the dice used to determine the extent of the moves of the players along the path on the board; and FIG. 8 represents a set of reward cards each of which, in the present embodiment, includes the picture of an animal found in or related to the ecology of the particular geographical region and an indication of a sum of money to be awarded to a player upon obtaining the card.

Figure 1:
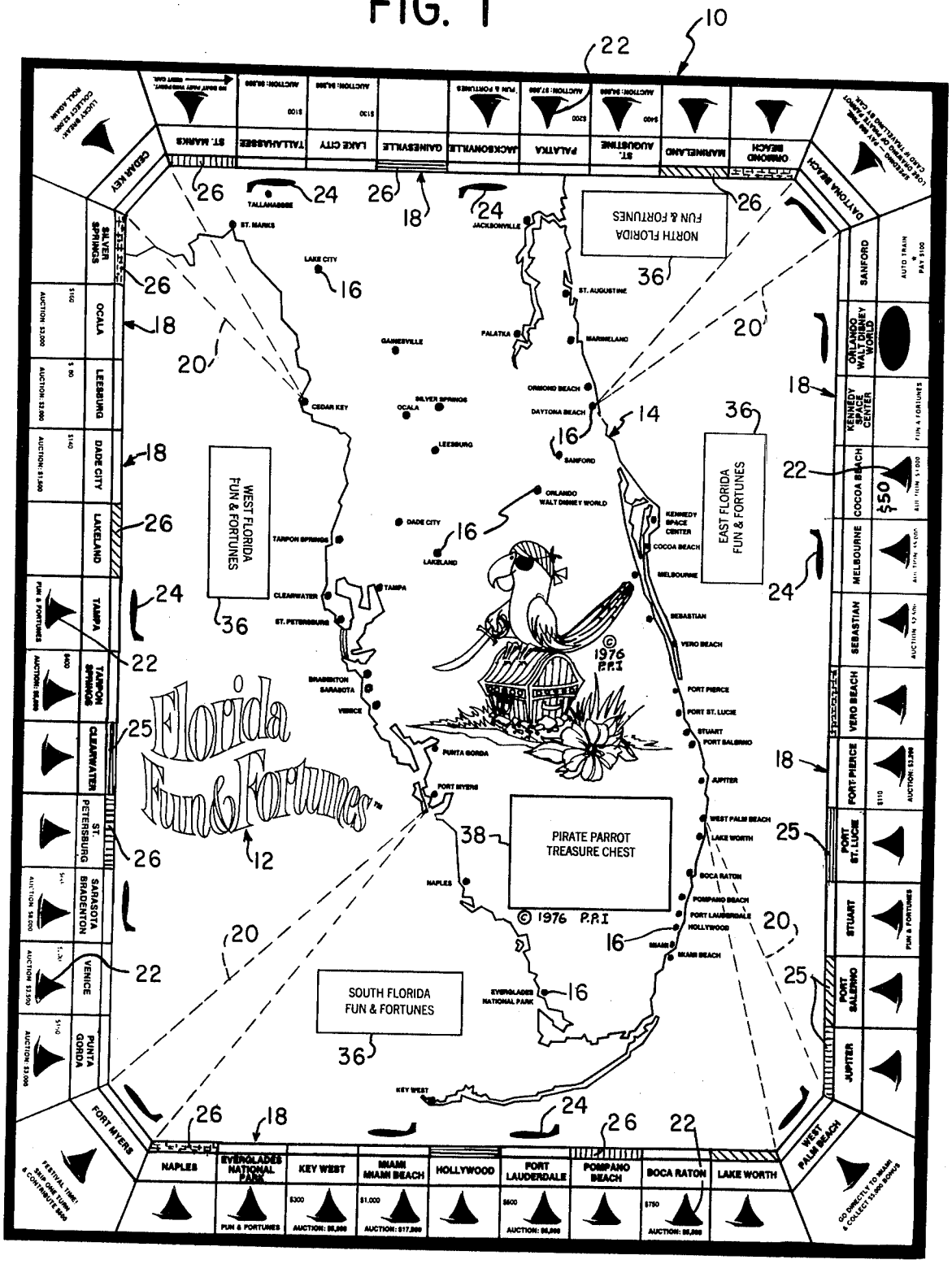
FIG. 1 is a plan view of one form of the board for the game, the name Florida Fun & Fortunes being shown inasmuch as this name is being used in marketing the present embodiment.

Before describing the play of the game in detail, a description of the playing materials comprising the game is advantageous. Referring first to FIG. 1, the board as a whole is generally denoted 10 and as the particular embodiment of the game disclosed in the drawings is known on the market as "Florida Fun & Fortunes", that name is indicated at 12 on the board. It should be understood that although the presently disclosed embodiment deals with the particular geographical region of Florida, other geographical localities are contemplated for which games coming within the scope of the present invention may be readily formulated. An outline of a map of Florida 14 (not necessarily to scale) is provided on the central area of the board 10. Some of the larger cities and other points of interest (46 in number in the disclosed embodiment) are indicated on the map 14 by appropriate markings 16, such for example as Hollywood, Daytona Beach, Everglades National Park, etc.

A series of marked areas 18 extend about the perimeter of the board constituting a path therearound. Each marked area represents one of the cities or points of interest 16 indicated on the map. Since board 10 is four-sided, the marked areas 18 on the right side of the board (as seen in FIG. 1) conveniently represent those cities and points of interest found in the eastern region of Florida. Similarly, those marked areas 18 on the lower, the left and the upper sides of the board conveniently designate the cities and points of interest located in the southern, western and northern areas of Florida, respectively. For example, the areas on the right side of the board designate Sanford, Orlando (Walt Disney World), Kennedy Space Center, etc. extending down to Jupiter. Dotted lines, denoted 20, emanate from those cities or points of interest designated by areas in the corners of the game board so that the players may readily ascertain the particular regions designated by the particular sides of the game board.

Besides being marked with the name of the particular city or point of interest (hereinafter, collectively called city) which it represents, each area has associated with it a boat or airplane designation 22, 24, respectively, indicative of whether the particular city is accessible to a tourist by boat, i.e., whether it is on a coast of Florida, and/or an airplane, i.e., whether the city has an airport so as to be accessible by air. Thus, for example, Cocoa Beach (east coast) has a boat designation 22 indicating that it is accessible by boat, Tallahassee (northern region) has an airplane designation 24 associated with it indicative of the fact that an airport is situated there, and Tampa (west coast) has both a boat 22 and airplane 24 designation associated with it indicative of the fact that it is accessible both by airplane and by boat. Some cities, e.g., Ocala, Leesburg and Dade City have neither boat nor airplane designations associated therewith indicating that they are accessible by neither. It is understood, however, that all of the cities represented on the board are accessible to a tourist by automobile.

Sixteen of the marked areas 18 have a portion 26 marked in color, in the present embodiment four being marked in blue, four in red, four in green and four in yellow. One of each of these color-coded areas 25 is found on each of the four sides of the board. For example, Lakeland, Marineland, Port Salerno, and Lake Worth are each marked in green. Those ares not being color-coded are marked either with a designation comprising an instruction to select a question card, described in detail hereinbelow, or may have an auction price associated with it for purposes also described in detail hereinbelow. For example, areas 18 designating Tampa, Everglades National Park, Stuart, Kennedy Space Center, and Jacksonville are provided with the designation, "Fun & Fortunes" which, as described below, denotes an instruction for a player who lands on that area to select a question card. On the other hand, areas 18 designating such localities as Sarasota, Bradenton, Miami Beach, Fort Pierce and Tallahassee have auction prices associated with them. Further, each of the areas having associated auction prices have expense fees also associated with them. For example, area 18 designating Key West, in addition to having an auction price also has an expense fee of $300.00 associated with it.

Four spaces 36 are located in the central board area, each being provided in one of the geographical regions defined by dotted lines 20. These spaces indicate the places where the sets of question and instruction cards, hereinafter referred to as "Fun & Fortunes" cards 46, are placed. Finally, a space 38 is provided on the game board, here being located within the outline of map 14, indicating the place where a set of reward cards, hereinafter referred to as "Pirate Parrot Treasure Chest" cards 64 are to be placed.

Areas 18 which occupy the four corners of the game board contain certain instructions which must be followed by the player who lands on such areas. For example, the area representing Daytona Beach, upon being landed upon, requires the player to pay a cash penalty and results in the loss of a Pirate Parrot card (reward card) under certain circumstances, explained below. Similarly, should a player land on the area 18 designating West Palm Beach, he is instructed to move his token to Miami and collect a cash bonus.

This completes the description of the game board 10. However, as mentioned hereinabove, it should be understood that other geographical regions may be used as a basis for the game board within the scope of the present invention with the areas 18 indicating other appropriate cities and/or points of interest within such regions. In such other embodiments of the game, the areas 18 will be marked with designations 22, 24 in a manner similar to that shown in the present embodiment, i.e., with designations indicating whether such areas are accessible by boat and/or airplane.

Figure 2A:
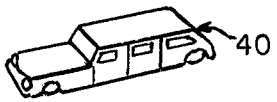
FIGS. 2(*a–c*) is a view of a set of token utilized by the players, each set including an automobile, a boat and an airplane.
Figure 2B:
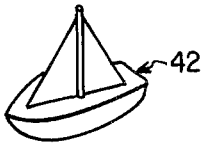
Figure 2C:
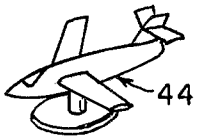

Referring to FIGS. 2*a* through *c*, these figures illustrate one set of tokens used by the various players to move around the game board. Each set includes an automobile 40 (FIG. 2*a*), a boat 42 (FIG. 2*b*) and an airplane 44 (FIG. 2*c*). Thus, each player is supplied with three tokens to use during the game, namely a car, a boat, and an airplane.

Figure 3A:
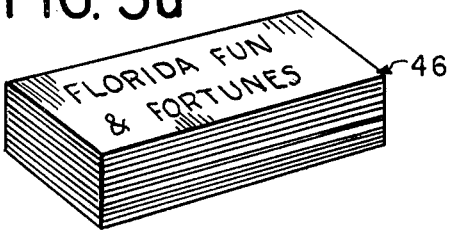
FIGS. 3(*a* and *b*) represent question and instruction cards (FIG. 3*a*) containing questions concerning tourist attractions of the geographical localities provided on the board while FIG. 3(*b*) represents corresponding answers to the questions on these cards.
Figure 3B:
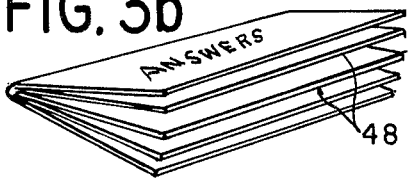

FIG. 3*a* illustrates the Florida Fun & Fortunes cards 46. Each card either contains instructions to "visit" a particular tourist attraction found in one of the cities contained on the game board, or may contain a question which may be answered by a "true" or "false". Finally, a card 46 may simply set forth a reward or penalty for the player choosing that card. In the preferred embodiment, there are two hundred such Florida Fun & Fortunes cards. Of these 200, 100 are of the "visit" or "true-false" type and these cards are numbered from 1 to 100. The remainder are penalty or reward cards. FIG. 3*b* illustrates an answer booklet 48 containing the correct answers to the questions contained on the numbered Florida Fun & Fortunes cards. For example, one of the numbered Florida Fun & Fortunes cards may say "Visit the Monkey Jungle". If the player correctly answers "Miami" (as verified by the answer in booklet 48) he may move his token to Miami. This will be explained in greater detail hereinbelow.

Figure 4:
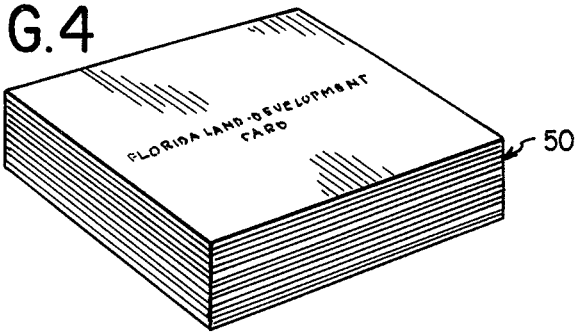
FIG. 4 represents title cards each representing ownership of a particular geographical locality shown on the board.

FIG. 4 illustrates a series of land development cards 50. Each land development card corresponds to a particular city represented by one of the areas on the game board. Each card gives information pertaining to the cost of making improvements in that particular area as well as the cost to an opposing player if he should land on the area designating that particular city during play of the game. Each land development card 50 actually represents the title or deed to property within a particular city.

Figure 5A:
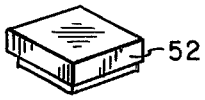
Figure 5B:
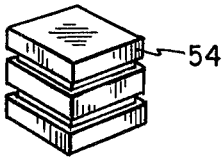
Figure 5C:
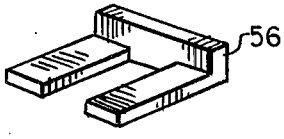
Figure 5D:
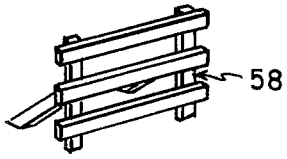

FIGS. 5*a* through *d* illustrate various symbols for improvements which may be made by a player to a city which he acquires. FIG. 5*a* illustrates a motel 52, FIG. 5*b* illustrates a condominium 54, FIG. 5*c* illustrates a marina club 56 and FIG. 5*d* is a symbol for a riding club 58. FIG. 6 illustrates scrip money or, as referred to in the present invention, travelers checks 60 which are provided in different denominations. FIG. 7 illustrates dice 62 used to determine the number of spaces to be moved during play of the game. Finally, FIG. 8 illustrates a set of Pirate Parrot Treasure Chest cards 64, each card having a picture of a character, e.g., animal, fish, etc. thereon and an indication of a cash reward to a player who obtains the card during play of the game.

A description of the manner in which the game is played will now be set forth. It should be understood, however, that this is merely one of several games which may be played using the apparatus described hereinabove. Each player is assigned a set of tokens, each set including a car 40, a boat 42 and an airplane 44 of the same color, either blue, red, green or yellow. Depending upon the assigned color, the player begins the game already owning those properties on the game board marked in the same color as his tokens. Each player is also issued a stated amount of scrip money 60 prior to beginning the game. Each player places his automobile token 40 on the area marked Orlando which functions as the starting position. The players then each roll one die in predetermined order, each player moving his automobile token the particular number of units shown. When using the automobile token, each and every area 18 must be counted in moving the token. If the player lands on a Fun & Fortunes position, such as the Kennedy Space Center, he draws a Fun & Fortunes card 46 from the deck for that region (east). If he draws a numbered "visit" card, he must correctly name the particular city in which the tourist attraction which the card requests him to visit is located. If the card sets forth a true-false question, the player must correctly answer that question. If the answer is not correct or the player does not correctly name the city in which the stated tourist attraction is located, he must pay each player a stated amount of money, for example, $5,000. He must also skip one turn. However, if the question is answered correctly, the player advances his card to the city indicated (in the case of correctly answering a "visit" card) and, upon arriving at that city, he draws a Pirate Parrot Card 64 and collects the reward stated thereon. The player retains the Pirate Parrot Card for further play. In this way, it may be seen that the players become educated as to the locations of various tourist attractions within the State of Florida. Additionally, all the players become familiar with the geography of the area by virtue of the map and the arrangement of the playing board. If the player correctly answers a true-false question, he draws a Pirate Parrot Card and collects his reward from the bank. In this case, the player remains in place. If a player draws an unnumbered card from the Fun & Fortunes deck, he simply follows the instructions on the card. Unless otherwise indicated, he pays to or collects from the bank whatever amount is mentioned on such an unnumbered card.

If a player lands on a property area 18 indicated to be available at auction, for example, Cocoa Beach, Melbourne, Sebastian, etc., he must pay the bank the "expense fee" shown on the game board (for example, $50.00 at Cocoa Beach) and then may open a bidding procedure to purchase the property at the price shown on the game board (for example, $3,000 for Cocoa Beach). Each player gets a chance to raise the initial bid. When all players have offered a bid, this is counted as one round of bidding. Any number, for example, three, of rounds may be conducted. The highest bidder at the end of three rounds then takes ownership of that property by paying the amount bid to the bank and retains the appropriate land development card 50. Any player, other than the owner, who lands on this property must now pay the owner an expense fee as well as rent, which latter amount is shown on the land development card.

If a player lands on a color-coded property area 18 not owned by him, he must pay the rent (camping fee) shown on the appropriate land development card to the owner of that property. Whenever a player lands on an opponent's property, that player loses one turn. If the player happens to own the property himself, he pays no rental and does not skip a turn. Instead, he may immediately roll again.

When a player has landed on an area which is his own property, he may improve it by installing a motel 52, condominium 54, etc., at a cost shown on the corresponding property card. However, he loses a turn when doing so. Under the preferred rules, no player can make improvements in property until he has first obtained at least one Pirate Parrot Treasure Chest Card 64 (by correctly answering a question set forth on a Fun & Fortunes card 46). Thus, correctly answering a Florida Fun & Fortunes card is a prerequisite to improvements on property. Accordingly, a thorough knowledge of the geographical region with which the game is concerned is rewarded by not only the cash reward obtained when correctly answering a Florida Fun & Fortunes question, but also by then being able to improve the properties which he owns.

While traveling by car, if a player lands on an area owned by an opponent, he must pay the owner the highest rental based upon the most expensive building installed on that property. If no buildings are installed, then he must pay the land rental (camping fee) for that position.

If the owner owns two adjacent pieces of property without buildings, the player must pay the combined land rental for both. If buildings are installed, the player must pay the highest single building rental even if the building is positioned on adjacent property.

Certain rules may be used in the event a particular player lands upon an area already occupied by one or more players. For example, if the area is designated a Fun & Fortunes position, each of the earlier players currently located in that area may lose an additional roll of the die. If the area is a property belonging to another player, all players in that area must pay twice the rental due.

After one circuit around the board by automobile, if a player has not obtained a Pirate Parrot Treasure Chest card, he must continue around the board still using his automobile token and, therefore, must still count each and every area in his movement. However, once a player has obtained at least one Pirate Parrot Treasure Chest card, and he has made one circuit around the board (having passed Orlando), he may now switch to the use of his boat token 42. When traveling by boat, players again use only one of the two dice. Also, importantly, only the areas having a boat designation 22 associated therewith are counted in the movement of the token and positions not having such designation may be skipped. A preferred rule is that players may not pass the area 18 designating St. Marks by boat. This naturally is due to the fact that there is no waterway connecting St. Marks and Jacksonville as may be seen from the map in its northernmost portion. Thus, when a player reaches St. Marks, he must stop there, change to his car token and roll the die again at his next turn. He then advances by car (counting every area) until he has landed on a boat position at or past Jacksonville whereupon the boat may be used again. Should a player traveling by boat be instructed by a Fun & Fortunes card to move to an area that does not contain a boat pictured on the game board, he advances to the furthest area having a boat designation before that area whereupon he changes, at his next turn, to his car. He then advances directly to the intended locality.

Should a player who is traveling by boat desire to stop in a land locked area (e.g., Lakeland, Dade City, Leesburg, etc.) in order to purchase such area, he must stop upon reaching a prior area having a boat designation 22 whereupon he may rent a car for a stated sum, e.g., $100.00, and roll the die again at his next turn.

Again, if a player has not obtained a Pirate Parrot Card 64 during his tour by boat around the game board, he must travel around again by boat until he does obtain one. Upon obtaining a Pirate Parrot Card while traveling by boat and thereupon passing Orlando, he must now switch to the airplane token 44 to continue his travels. In traveling by plane, the player actually has the most versatility in the movement of his tokens so as to enable him to get to areas 18 having Fun & Fortunes designations in order to provide chances for acquiring further Pirate Parrot Cards. When traveling by plane, a player rolls both dice and may choose one of the two numbers shown on his roll of the dice as his move for the airplane token. He advances his plane in the usual manner that number of spaces, counting only the areas marked with the airplane designation 24. The other number shown on the second die may be the player's move by boat from his landing spot by plane. If no boat appears on the landing spot on the game board (such as Tallahassee and Orlando), the player must travel by car from that landing spot until he lands at a boat position. Once there, he must skip one turn while switching to his boat.

With respect to improving the properties, only one building of each type may be installed on a single property. Each land development card indicates the types of buildings which may be installed on each property. Although an owner can install a building at any time in the game when it is his turn to move, he must start with the least expensive building, i.e., the motel 52 and may then install the marina club 56 (or riding club 58 where applicable) and then the condominium 54. Of course, buildings may be installed only on areas 18 having land developments cards, i.e., the color-coded areas and those available at auction. The value of a particular property is determined by the sum of the individual buildings and the particular land value of that area. Property (with buildings) may be sold to the bank or to any other player at or above the value shown on the land development card. If more than one player is interested in buying such property, the property may be auctioned.

The game ends when one or more of the following situations occur: a predetermined time limit has been reached; all of the Pirate Parrot Treasure Chest Cards have been drawn, or when all competing players concede. At the point in time when the game ends, the player with the largest holdings in cash plus land and buildings is the winner.

As stated hereinabove, the rules described above are illustrative only and other rules may be adopted.

It is clear from the description of the game that the players are educated as to the particular points of interest, attractions and geography of the area with which the game is concerned. The unique cooperation of the areas designating the cities and/or points of interest as being accessible by car, boat and/or airplane with the particular similarly shaped tokens adds another educational feature to the game, indicating which cities and points of interest are accessible by car, boat and/or airplane.

The Pirate Parrot Treasure Chest Cards, as indicated above, may contain pictures of animals indigenous to the area with which the game is concerned to further add another educational element to the game. Obviously, numerous modifications and variations of the game are possible in the light of the above teachings. Accordingly, the game may be practiced other than as specifically described hereinabove.

What is claimed is:

1. A board game apparatus designed to acquaint players with a predetermined region as represented on a map, said apparatus comprising:

a board having predefined directions thereon corresponding to directions on said map and including a series of marked areas forming a path extending about said board, each of said areas representing a particular locality within said region, having indicia therein identifying said locality, and being disposed on said board to correspond generally with the location of said locality on said map, selected ones of said marked areas on said board being designated as accessible only by indicated modes of transportation;

at least one token means, each token means being dedicated to a different player and being moveable for transportation along said path, said token means comprising a set of tokens wherein each token represents a different mode of transportation for use by the corresponding player, each token being moveable only on marked areas corresponding to localities accessible by the corresponding mode of transportation; and means for determining the movement of said token means about said path.

2. A board game apparatus as recited in claim 1 wherein said region is an existing geographical region, said localities being geographical localities existing within said region, said accessibility designations being indicative of the actual accessibility of said localities by land, water and air, said tokens corresponding, respectively, to means for travelling by land, water and air.

3. A board game apparatus as recited in claim 2 wherein selected ones of said areas are designated by colors so as to constitute a distinguishable group.

4. A board game apparatus as recited in claim 3 wherein each such area comprising one of said groups is on a different side of said board.

5. A board game apparatus as recited in claim 2 wherein selected areas have indicia indicating charges required for the use and occupancy of said areas by opponent players.

6. A board game apparatus as recited in claim 5 further comprising means for increasing the rentals for a particular area by the acquisition of localities represented by areas adjacent to said particular area.

7. A board game apparatus as recited in claim 2 further including a set of cards, each card having indicia thereon representing either a question whose answer is one of said geographical localities on said board or other instructions, selected areas on said board having instructions thereon to select one of said set of cards upon a player landing thereon.

8. A board game apparatus as recited in claim 7 further including a set of reward cards, a player obtaining one of said reward cards upon correctly answering a question contained on a question card.

9. A board game apparatus as recited in claim 2 further including a set of cards, each card representing the ownership of a particular one of said geographical localities, each said card containing indicia thereon indicative of the value of said locality at various stages of improvement.

10. A board game apparatus as recited in claim 9 further including a set of pieces for the purpose of purchase and placement on said areas representative of improvements in said geographical localities represented by said areas.

11. A board game apparatus as recited in claim 2 wherein selected ones of said areas have indications of opening bids required for a player to purchase the locality represented by said area.

12. A board game apparatus as recited in claim 2 wherein each of said tokens is constructed and arranged to be distinguishable from every other token and has a priority designation, a higher priority token being moveable only after every lower priority token has made a complete circuit of said path.

13. The method of using a board game apparatus in accordance with claim 12 including the step of disabling the movement of each token until a complete circuit has been made with the token of next lower priority and at least one reward card has been acquired by the corresponding player in the course of said circuit.

14. A board game apparatus as recited in claim 1 wherein selected ones of said areas are designated by colors so as to constitute a distinguishable group.

15. A board game apparatus as recited in claim 14 wherein each such area comprising one of said groups is on a different side of said board.

16. A board game apparatus as recited in claim 1 wherein selected ones of said areas have indications of opening bids required for a player to purchase the locality represented by said area.

17. A board game apparatus as recited in claim 1 wherein selected areas have indicia indicating charges required for the use and occupancy of said areas by opponent players.

18. A board game apparatus as recited in claim 17 further comprising means for increasing the rentals for a particular area by the acquisition of localities represented by areas adjacent to said particular area.

19. A board game apparatus as recited in claim 1 which is adapted to acquaint each player with sites in said region and further comprises a set of cards including cards having a question with respect to said region which must be answered by a player and cards including instructions, selected areas on said board having instructions thereon to select one of said set of cards upon a player landing on one of said selected areas.

20. A board game apparatus as recited in claim 19 further comprising a set of reward cards, a player obtaining one of said reward cards upon correctly anwering a question contained on a question card.

21. A board game apparatus as recited in claim 1 further comprising a set of property cards, each property card representing the ownership of a particular one of said localities, each said card containing indicia thereon indicative of the value of said locality at various stages of improvement.

22. A board game apparatus as recited in claim 21 further comprising a set of indicators for purchase, said indicators representing improvements in said localities represented by said areas.

23. A board game apparatus as recited in claim 1 wherein each of said tokens is constructed and arranged to be distinguishable from every other token and has a priority designation, a higher priority token being moveable only after every lower priority token has made a complete circuit of said path.

24. The method of using a board game apparatus in accordance with claim 23 including the step of disabling the movement of each token until a complete circuit has been made with the token of next lower priority and at least one reward card has been acquired by the corresponding player in the course of said circuit.

25. A board game apparatus as recited in claim 1 wherein said map is included on said board and said path surrounds said map.

* * * * *